US010744630B2

(12) United States Patent
Pomeroy et al.

(10) Patent No.: US 10,744,630 B2
(45) Date of Patent: Aug. 18, 2020

(54) GAS SPRING FASTENER DRIVER INCLUDING SHUTTER VALVE

(71) Applicant: TTI (MACAO COMMERCIAL OFFSHORE) LIMITED, Macau (MO)

(72) Inventors: Edward Pomeroy, Piedmont, SC (US); Zachary Scott, Easley, SC (US); John Schnell, Anderson, SC (US); Essam Namouz, Greenville, SC (US)

(73) Assignee: TTI (MACAO COMMERCIAL OFFSHORE) LIMITED, Macau (MO)

( * ) Notice: Subject to any disclaimer, the term of this patent is extended or adjusted under 35 U.S.C. 154(b) by 355 days.

(21) Appl. No.: 15/807,734

(22) Filed: Nov. 9, 2017

(65) Prior Publication Data

US 2018/0126532 A1 May 10, 2018

Related U.S. Application Data

(60) Provisional application No. 62/419,616, filed on Nov. 9, 2016.

(51) Int. Cl.
*B25C 1/04* (2006.01)
*B25C 5/13* (2006.01)
(Continued)

(52) U.S. Cl.
CPC ..... *B25C 1/047* (2013.01); *B25C 1/04* (2013.01); *B25C 1/06* (2013.01); *B25C 5/13* (2013.01); *B25C 1/008* (2013.01)

(58) Field of Classification Search
CPC ..... B25C 1/04; B25C 1/047; B25C 1/046; B25C 1/08; B25C 1/008; B25C 1/042; B25C 5/13
(Continued)

(56) References Cited

U.S. PATENT DOCUMENTS 4,215,808 A 8/1980 Sollberger et al.
4,986,164 A 1/1991 Crutcher
(Continued)

FOREIGN PATENT DOCUMENTS

CN 105818099 A 8/2016
WO 2015143762 A1 10/2015

OTHER PUBLICATIONS

European Patent Office Search Report for Application No. 17800821.1 dated Apr. 25, 2018, 8 pages.

*Primary Examiner* — Scott A Smith
(74) *Attorney, Agent, or Firm* — Michael Best & Friedrich LLP

(57) ABSTRACT

A fastener driver comprises a drive blade movable from a retracted position to an extended, driven position for driving a fastener into a workpiece and a gas spring mechanism for driving the drive blade from the retracted position to the driven position. The gas spring mechanism includes a drive cylinder and a drive piston attached to the drive blade for movement therewith. The drive piston is acted on by a driving force resulting from a pressure differential created by the gas spring mechanism. The fastener driver also includes an adjustable valve for selectively limiting a flow of gas into the drive cylinder above the drive piston, or a flow of ambient air at atmospheric pressure from the drive cylinder beneath the drive piston, thereby changing the pressure differential acting on the drive piston, as the drive piston and the drive blade move from the retracted position to the extended position.

17 Claims, 4 Drawing Sheets

(51) Int. Cl.
*B25C 1/06* (2006.01)
*B25C 1/00* (2006.01)

(58) Field of Classification Search
USPC ..... 227/8, 130, 132, 146, 134
See application file for complete search history.

(56) References Cited

U.S. PATENT DOCUMENTS 5,720,423 A * 2/1998 Kondo ..... B25C 1/04
227/130
6,854,631 B2 * 2/2005 Burke ..... B25C 1/042
137/625.66
7,503,473 B2 * 3/2009 Niblett ..... B25C 1/008
227/10
7,938,142 B2 * 5/2011 Migliorati ..... F16K 15/148
137/625.44
8,011,441 B2 * 9/2011 Leimbach ..... B25C 1/06
173/1
8,763,874 B2 * 7/2014 McCardle ..... B25C 1/047
227/129
8,875,969 B2 * 11/2014 Pedicini ..... B25C 1/04
227/10
8,960,516 B2 * 2/2015 Iijima ..... B25B 21/023
227/10

* cited by examiner

GAS SPRING FASTENER DRIVER INCLUDING SHUTTER VALVE

CROSS-REFERENCE TO RELATED APPLICATIONS

This application claims priority to U.S. Provisional Patent Application No. 62/419,616 filed on Nov. 9, 2016, the entire content of which is incorporated herein by reference.

FIELD OF THE INVENTION

The present invention relates to power tools, and more particularly to gas spring fastener drivers.

BACKGROUND OF THE INVENTION

There are various fastener drivers used to drive fasteners (e.g., nails, tacks, staples, etc.) into a workpiece known in the art. These fastener drivers operate utilizing various means (e.g., compressed air generated by an air compressor, electrical energy, flywheel mechanisms) known in the art, but often these designs are met with power, size, and cost constraints.

SUMMARY OF THE INVENTION

The present invention provides, in one aspect, a fastener driver comprising a drive blade movable from a retracted position to an extended, driven position for driving a fastener into a workpiece and a gas spring mechanism for driving the drive blade from the retracted position to the driven position. The gas spring mechanism includes a drive cylinder and a drive piston within the drive cylinder attached to the drive blade for movement therewith. The drive piston is acted on by a driving force resulting from a pressure differential created by the gas spring mechanism. The fastener driver also includes an adjustable valve for selectively limiting a flow of gas into the drive cylinder above the drive piston, or a flow of ambient air at atmospheric pressure from the drive cylinder beneath the drive piston, thereby changing the pressure differential acting on the drive piston, as the drive piston and the drive blade move from the retracted position to the extended position.

Other features and aspects of the invention will become apparent by consideration of the following detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

DETAILED DESCRIPTION

Figure 1:
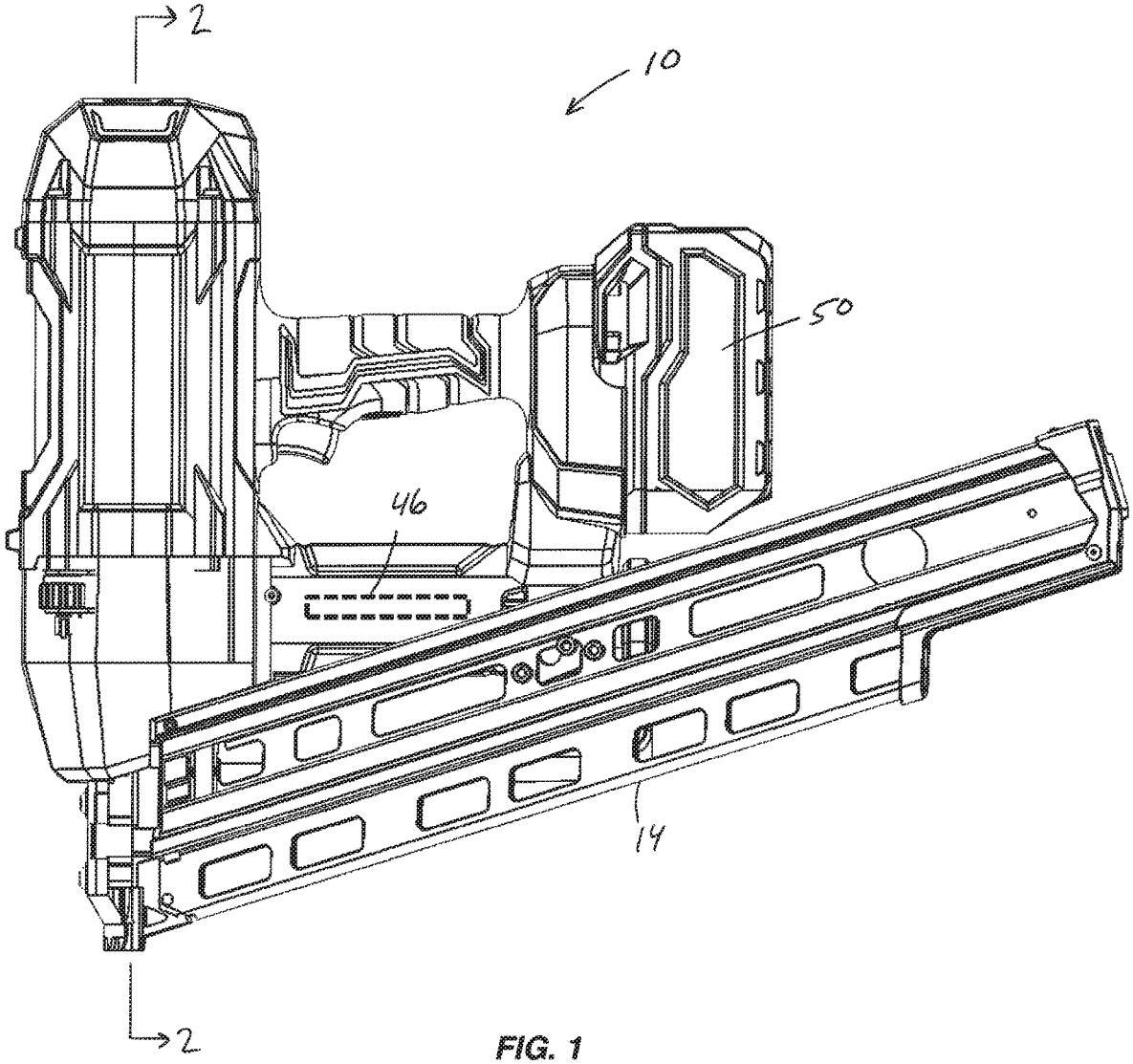
FIG. 1 is a side view of a gas spring fastener driver in accordance with an embodiment of the invention
Figure 2:
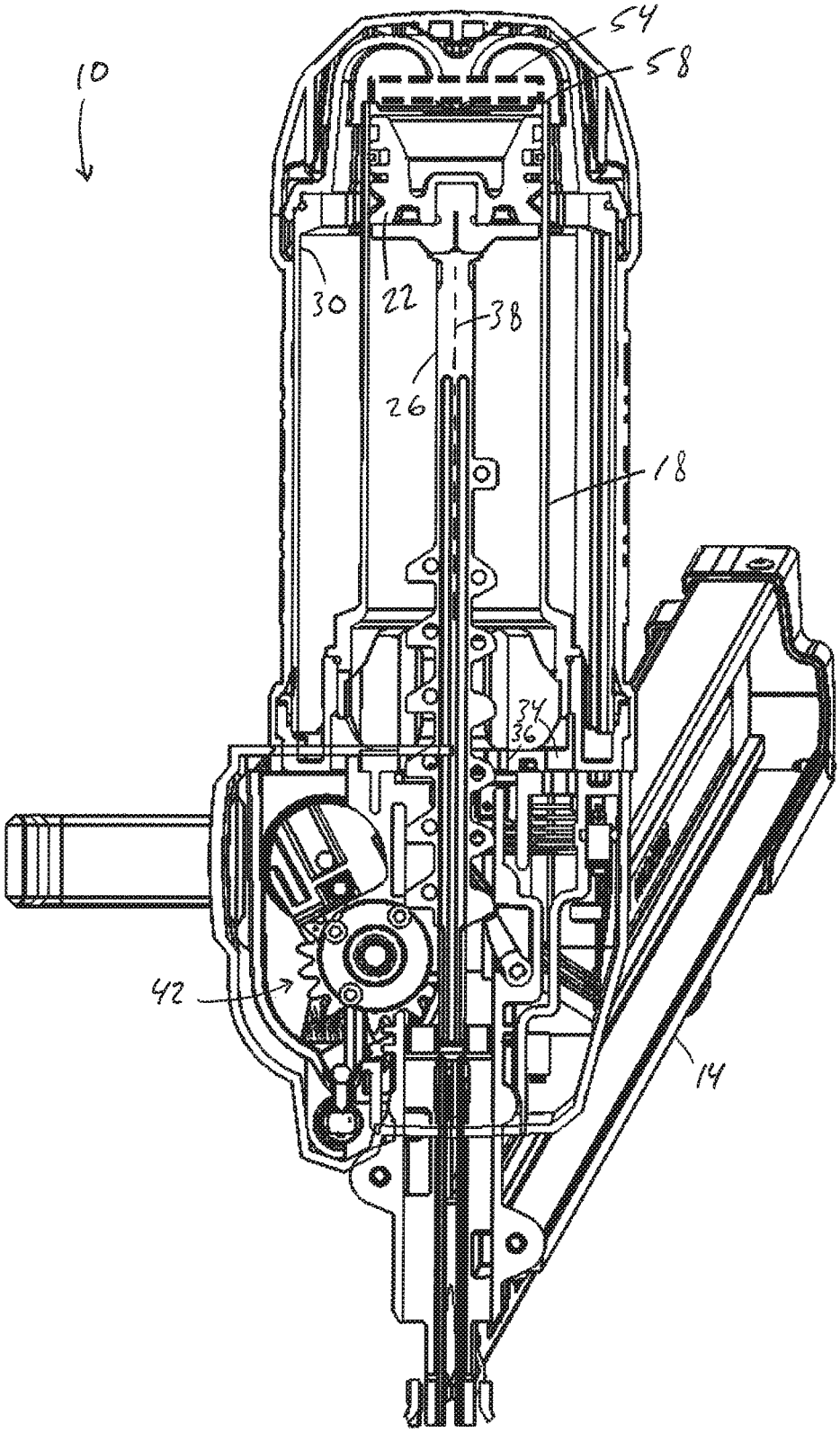
FIG. 2 is a cross-sectional view of the gas spring fastener driver of FIG. 1 along line 2-2, with portions removed.

With reference to FIG. 1, a gas spring-powered fastener driver 10 is operable to drive fasteners (e.g., nails, tacks, staples, etc.) held within a magazine 14 into a workpiece. The fastener driver 10 includes a drive cylinder 18 and a moveable drive piston 22 positioned within the cylinder 18 (FIG. 2). The fastener driver 10 also includes a drive blade 26 that is attached to the piston 22 for movement therewith. The fastener driver 10 does not require an external source of air pressure, but rather includes a storage chamber cylinder 30 of pressurized gas (e.g., compressed air) in fluid communication with a portion of the cylinder 18 above the drive piston 22. The portion of the cylinder 18 beneath the drive piston 22, however, is in fluid communication with ambient air at atmospheric pressure. Specifically, the fastener driver 10 includes a cylinder end cap 34 fastened to a lower end of the cylinder 18 having one or more apertures 36 through which ambient air may pass as the drive piston 22 moves within the cylinder 18. In the illustrated embodiment, the cylinder 18 and drive piston 22 are positioned within and coaxial with the storage chamber cylinder 30.

With continued reference to FIG. 2, the cylinder 18 and the drive blade 26 define a driving axis 38, and during a driving cycle the drive blade 26 and piston 22 are moveable between a retracted position (e.g., a top dead center position within the cylinder 18) and an extended, driven position (e.g., a bottom dead center position within the cylinder 18). The fastener driver 10 further includes a lifting mechanism 42, which is powered by a motor 46, and which is operable to return the drive blade 26 and piston 22 from the driven position to the ready position. A battery 50 (FIG. 1) is electrically connectable to the motor 46 for supplying electrical power to the motor 46. In alternative embodiments, the fastener driver 10 may be powered from an AC voltage input (i.e., from a wall outlet).

Figure 3:
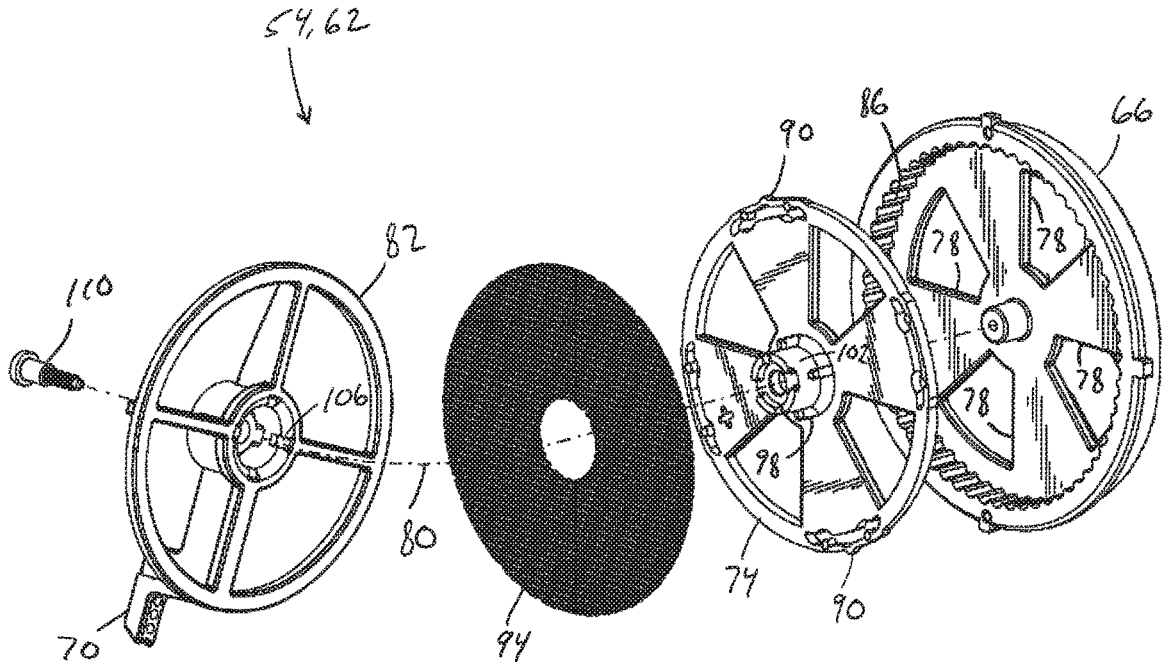
FIG. 3 is an exploded perspective view of an adjustable valve for use with the gas spring fastener driver of FIG. 1.

The fastener driver 10 further includes an adjustable valve 54 (FIGS. 2-5) proximate an inlet 58 of the cylinder 18 for selectively limiting a flow of gas into the cylinder 18 above the drive piston 22, thereby changing the pressure differential acting on the drive piston 22, as the drive piston 22 and the drive blade 26 move from the retracted position to the driven position. Consequently, this changes the force acting on the drive blade 26 which, in turn, changes a driving depth of the fasteners into a workpiece. With reference to FIG. 3, the adjustable valve 54 is configured as an adjustable shutter assembly 62 including an end cap 66, an adjustment mechanism (i.e., a lever 70), and a shutter 74. The end cap 66 is secured to the cylinder 18 proximate the inlet 58 and includes apertures 78 formed therein. The lever 70 is manipulatable by a user of the fastener driver 10 and is integrally formed with a frame 82 that is securely attached to the shutter 74 for co-rotation therewith. Any of a number of different linkages could be used to interconnect the lever 70 with an external lever (not shown) accessible by the user of the fastener driver 10. In alternative embodiments, the lever 70 can by any type of adjustment member (e.g., a knob, a slide, etc.) and can be movable in any fashion (e.g., by pivoting, sliding, etc.).

The shutter 74 is rotatable about an axis 80, which in the illustrated embodiment of the fastener driver 10 is coaxial with the driving axis 38, to block a portion of each of the apertures 78 (FIG. 4) or none of the apertures 78 (FIG. 5) formed in the end cap 66. When the apertures 78 are unblocked by the shutter 74, either partially or fully, the apertures 78 are exposed to the pressure of the compressed air within the storage chamber cylinder 30. In other words, the lever 70 is rotatable to adjust the rate that compressed gas from the storage chamber cylinder 30 can flow into the cylinder 18 and above the drive piston 22, as the drive piston 22 and drive blade 26 move from the extended position to the drive position.

Figure 4:
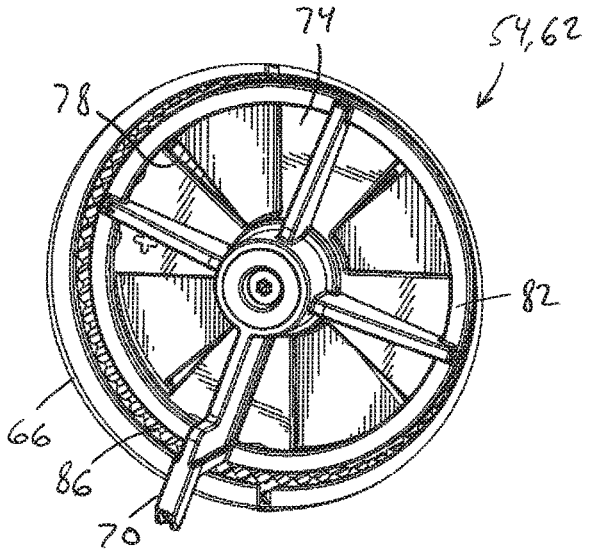
FIG. 4 is an assembled perspective view of the adjustable valve of FIG. 3 shown in a nominally closed state.
Figure 5:
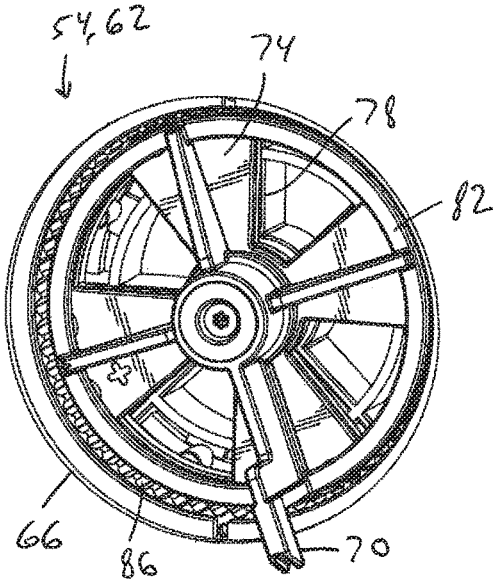
FIG. 5 is an assembled perspective view of the adjustable valve of FIG. 3 shown in a fully opened state.

With reference to FIG. 3, the end cap 66 includes a plurality of teeth 86 that are engageable by opposed detents 90 provided on the shutter 74 for holding the shutter 74 and lever 70 in the positions shown in FIGS. 4 and 5, and any intermediate position therebetween. With reference to FIG. 3, a screen 94 (not shown for clarity in FIGS. 4 and 5) is sandwiched between the frame 82 and the shutter 74, and prevents any debris in the storage chamber cylinder 30 from entering the cylinder 18 through the apertures 78. The frame 82 is secured to the shutter 74 for co-rotation therewith by ribs 98 formed on a hub 102 of the shutter 74 that are received in corresponding grooves 106 formed in the frame 82. In addition, a fastener 110 secures the frame 82 and the shutter 74 to the end cap 66, which is secured to the cylinder 18 (e.g., with an interference fit, etc.). In alternative embodiments, the lever 70, the frame 82, the shutter 74, and the screen 94 can be integrally formed as a single component.

By adjusting the lever 70, and correspondingly the portion of each of the apertures 78 blocked by the shutter 74, a user may adjust the force applied to the drive piston 22 and the drive blade 26. Specifically, the shutter 74 adjusts the pressure differential acting on the drive piston 22 by providing a controlled bleed through the apertures 78 to the replacement compressed air in the storage chamber cylinder 30. For example, with the majority of each aperture 78 closed (FIG. 4), a relatively low pressure (compared to the pressure in the storage chamber cylinder 30) is formed in the cylinder 18 above the drive piston 22 as it descends in the cylinder 18 during a fastener driving operation because the rate at which replacement air can be drawn from the storage chamber cylinder 30 in relatively low. This yields a relatively small pressure differential acting on the drive piston 22, causing the drive piston 22 and the drive blade 26 to be driven with a relatively lower force. Alternatively, with the apertures 78 completely unblocked by the shutter 74 (FIG. 5), the top of the drive piston 22 is exposed to substantially the same pressure of the storage chamber cylinder 30 as the drive piston 22 descends in the cylinder 18. This yields a relatively large pressure differential acting on the drive piston 22, causing the drive piston 22 and the drive blade 26 to be driven with a relatively higher force.

In operation of the fastener driver 10, the lifting mechanism 42 drives the piston 22 and the drive blade 26 to the ready position by energizing the motor 46. As the piston 22 and the drive blade 26 are driven to the ready position, the gas above the piston 22 and the gas within the storage chamber cylinder 30 is compressed. Once in the ready position, the piston 22 and the drive blade 26 are held in position until released by user activation of a trigger (not shown). When released, the compressed gas above the piston 22 and within the storage chamber cylinder 30 drives the piston 22 and the drive blade 26 to the driven position, thereby driving a fastener into a workpiece. If the user desires to reduce the depth to which fasteners are driven into the workpiece, the user closes the shutter 74 as described above, thereby blocking a substantial portion of the apertures 78 in the end cap 66 and limiting the flow of compressed replacement air from the storage chamber cylinder 30 through the inlet 58 of the cylinder 18 as the drive piston 22 and drive blade 26 move toward the driven position. As explained above, this reduces the pressure differential acting on the drive piston 22, and therefore the resultant force applied to the drive blade 26 is also reduced. However, if the user desires to increase the depth to which fasteners are driven into the workpiece, the user opens the shutter 74 as described above, thereby unblocking the apertures 78 so that the storage chamber cylinder 30 and the portion of the cylinder 18 above the drive piston 22 effectively become a single contiguous volume in which compressed air at a generally uniform pressure acts upon the top of the drive piston 22. As explained above, this increases the pressure differential acting on the drive piston 22, and therefore the resultant force applied to the drive blade 26 is also increased.

Figure 6:
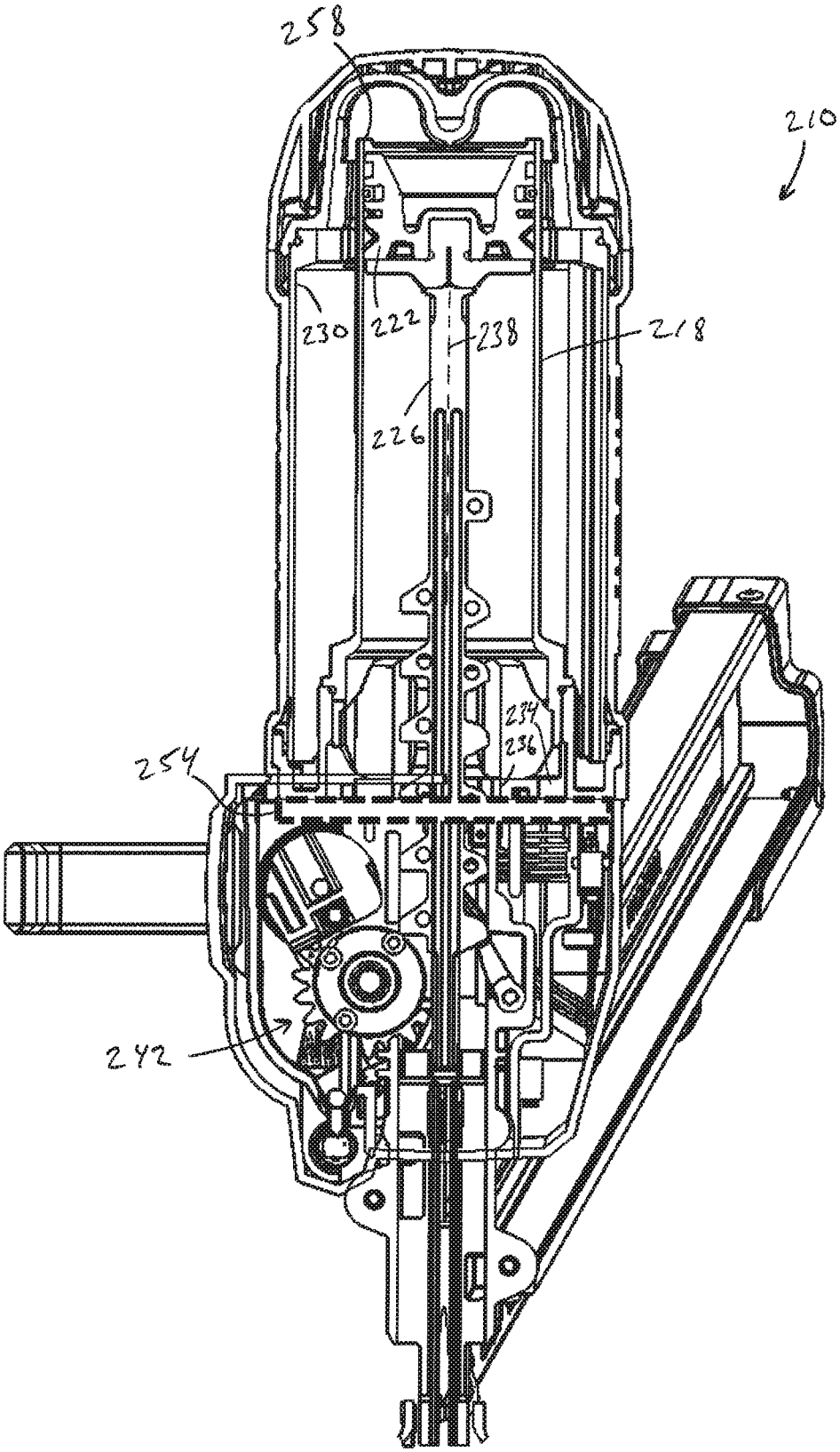
FIG. 6 is a cross-sectional view, similar to that of FIG. 2, of a gas spring fastener driver in accordance with another embodiment of the invention.

FIG. 6 illustrates an alternative embodiment of a gas spring-powered fastener driver 210, with like features shown with like reference numerals plus "200." The fastener driver 210 is otherwise identical to the fastener driver 10 shown in FIGS. 1 and 2, except that the adjustable valve 254 is positioned adjacent the cylinder end cap 234. In this embodiment, the apertures 278 through the end cap 266 of the adjustable valve 254 are in alignment with the one or more apertures 236 in the cylinder end cap 234. Accordingly, the adjustable valve 254 is operable to selectively limit a flow of ambient air at atmospheric pressure from the cylinder 218 beneath the drive piston 222, thereby changing the pressure differential acting on the drive piston 222, as the drive piston 222 and the drive blade 226 move from the retracted position to the extended position.

Specifically, when the adjustable valve 254 is in a nominally closed state (as shown in FIG. 4), the rate at which the ambient air in the cylinder 218 beneath the drive piston 222 may escape the cylinder 218, as the drive piston 222 moves toward the driven position, is relatively lower compared to the instance where the adjustable valve 254 is in an opened state (as shown in FIG. 5). As a result, the pressure of the ambient air in the cylinder 218 beneath the drive piston 222 is higher when the adjustable valve 254 is in the nominally closed state (FIG. 4) compared to the opened state (FIG. 5), leading to a relatively lower pressure differential acting on the drive piston 222 when the adjustable valve 254 is in the nominally closed state (FIG. 4). The operation of the fastener driver 210 is otherwise identical to the description above for the fastener driver 10 of FIGS. 1 and 2.

In an alternative embodiment of the fastener driver 210 of FIG. 6, the cylinder end cap 234 may be integrally formed with the end cap 266 of the adjustable valve 254 as a single piece. Or, the cylinder end cap 234 may be omitted in lieu of attaching the end cap 266 of the adjustable valve 254 directly to the lower end of the cylinder 218.

Various features of the invention are set forth in the following claims.

What is claimed is:

1. A fastener driver comprising:

a drive blade movable from a retracted position to an extended, driven position for driving a fastener into a workpiece;

a gas spring mechanism for driving the drive blade from the retracted position to the driven position, the gas spring mechanism including a drive cylinder, a drive piston within the drive cylinder attached to the drive blade for movement therewith, the drive piston being acted on by a driving force resulting from a pressure differential created by the gas spring mechanism, and a storage chamber cylinder containing gas therein;

an adjustable valve for selectively limiting a flow of gas into the drive cylinder above the drive piston, or a flow of ambient air at atmospheric pressure from the drive cylinder beneath the drive piston, thereby changing the pressure differential acting on the drive piston, as the drive piston and the drive blade move from the retracted position to the extended position, wherein the storage chamber cylinder is in fluid communication with the drive cylinder via the adjustable valve; and a lifting mechanism for returning the drive blade from the extended position to the retracted position;

wherein the gas in the storage chamber cylinder and the gas in the drive cylinder above the drive piston is compressed in response to the lifting mechanism returning the drive blade from the extended position to the retracted position.

2. The fastener driver of claim 1, wherein the adjustable valve further comprises an adjustment mechanism that is movable to adjust the flow of gas into the drive cylinder above the drive piston, or a flow of ambient air at atmospheric pressure from the drive cylinder beneath the drive piston.

3. The fastener driver of claim 1, wherein the adjustable valve further comprises an end cap secured to one end of the drive cylinder, the end cap having an aperture therein, and a shutter movable to block at least a portion of the aperture.

4. The fastener driver of claim 3, wherein the shutter is movable between a first position in which the aperture is substantially unblocked and a second position in which the aperture is substantially blocked, and wherein the pressure differential acting on the drive piston when the shutter is in said first position is greater than when the shutter is in the second position.

5. The fastener driver of claim 4, wherein the adjustable valve further comprises an adjustment mechanism that is manipulatable by a user of the fastener driver and that is coupled to the shutter for moving the shutter between the first and second positions.

6. The fastener driver of claim 5, wherein the adjustment mechanism is a lever coupled for co-rotation with the shutter.

7. The fastener driver of claim 6, wherein the adjustable valve further comprises a frame with which the lever is integrally formed as a single piece; and a screen positioned between the frame and the shutter, wherein the screen is coupled for co-rotation with the shutter and the frame.

8. The fastener driver of claim 4, wherein the shutter is rotatable relative to the end cap about a rotational axis.

9. The fastener driver of claim 8, wherein the drive blade reciprocates along a driving axis, and wherein the rotational axis is coaxial with the driving axis.

10. The fastener driver of claim 8, wherein the adjustable valve further comprises a plurality of teeth defined on one of the end cap or the shutter; and at least one detent defined on the other of the end cap or the shutter, wherein the detent is engageable with the teeth to hold the shutter in the first position or the second position.

11. The fastener driver of claim 10, wherein the teeth are defined on the end cap, and wherein the detent is defined on the shutter.

12. The fastener driver of claim 11, wherein the detent is a first detent, and wherein the adjustable valve further comprises a second detent defined on the shutter on an opposite side of the rotational axis as the first detent.

13. The fastener driver of claim 1, wherein the adjustable valve is located above the drive piston in a top portion of the drive cylinder.

14. The fastener driver of claim 13, wherein the adjustable valve selectively limits a flow of gas into the drive cylinder above the drive piston, thereby changing the pressure differential acting on the drive piston.

15. The fastener driver of claim 1, wherein the adjustable valve is located below the drive piston proximate a bottom portion of the drive cylinder.

16. The fastener driver of claim 15, wherein the adjustable valve selectively limits a flow of ambient air at atmospheric pressure from the drive cylinder beneath the drive piston, thereby changing the pressure differential acting on the drive piston.

17. The fastener driver of claim 15, wherein the gas spring mechanism includes a cylinder end cap adjacent a bottom portion of the drive cylinder, wherein the cylinder end cap includes an aperture fluidly communicating the bottom portion of the drive cylinder with atmosphere, and wherein the adjustable valve selectively limits a flow of ambient air at atmospheric pressure from the drive cylinder beneath the drive piston and through the aperture in the cylinder end cap, thereby changing the pressure differential acting on the drive piston.

* * * * *